US005105500A

United States Patent [19]

Bordogna

[11] Patent Number: 5,105,500

[45] Date of Patent: Apr. 21, 1992

[54] PAINT ROLLER

[76] Inventor: John Bordogna, 4304 Allendale Ct., Lincoln, Nebr. 68516

[21] Appl. No.: 639,288

[22] Filed: Jan. 10, 1991

[51] Int. Cl.[5] ..... B05C 17/02

[52] U.S. Cl. ..... 15/230.11; 29/110.5

[58] Field of Search ..... 15/230.11; 29/110.5, 29/116.1

[56] References Cited

U.S. PATENT DOCUMENTS

| | | | |
|---|---|---|---|
| 2,896,243 | 7/1959 | Schoenfield et al. | 15/230.11 |
| 3,886,621 | 6/1975 | Welsh | 15/230.11 X |
| 4,196,491 | 4/1980 | Baril | 15/230.11 |
| 4,304,025 | 12/1981 | Christenson | 15/230.11 |
| 4,528,714 | 7/1985 | Beck | 15/230.11 |

FOREIGN PATENT DOCUMENTS

| | | | |
|---|---|---|---|
| 555814 | 4/1958 | Canada | 15/230.11 |
| 103166 | 12/1963 | Norway | 15/230.11 |

*Primary Examiner*—Edward L. Roberts
*Attorney, Agent, or Firm*—Zarley, McKee, Thomte, Voorhees & Sease

[57] ABSTRACT

A paint roller comprising an elongated rod having end portions connected by an intermediate portion which is disposed at an angle with respect thereto. The end portions are offset from one another and have their longitudinal axes disposed parallel to one another. A handle is mounted on one of the end portions and a paint applicator roller is mounted on the other end portion.

1 Claim, 2 Drawing Sheets

PAINT ROLLER

BACKGROUND OF THE INVENTION

This invention relates to a paint roller and more particularly to a relatively small paint roller which may be used to paint such surfaces as railings, spindles, cylinders, etc.

Many types of paint rollers have been previously described and generally comprise a handle portion having a rod extending therefrom upon which the roller is rotatably mounted. Historically, the conventional paint rollers dispose the axis of rotation of the roller at 90 degrees with respect to the longitudinal axis of the handle. Additionally, other prior art paint rollers have disposed the longitudinal or rotational axis of the roller at an angle with respect to the longitudinal axis of the handle. However, applicant believes that the prior art paint rollers are not convenient to use and do not permit the efficient painting of such surfaces as railings, spindles, cylinders, etc.

It is therefore a principal object of the invention to provide an improved paint roller.

Still another object of the invention is to provide a paint roller having a relatively small paint applicator roller rotatably mounted at one end thereof.

Still another object of the invention is to provide a paint roller having offset end portions which are disposed parallel to one another with one of the end portions having a handle mounted thereon and the other end portion having a paint applicator roller mounted thereon.

Still another object of the invention is to provide a paint roller having certain dimensions which permits the continual use thereof without the painter suffering from carpal tunnel injury.

Still another object of the invention is to provide a paint roller wherein the dimensions are such that excess paint may be removed from the paint applicator roller without the need of a paint tray.

These and other objects of the present invention will be apparent to those skilled in the art.

SUMMARY OF THE INVENTION

Figure 1:
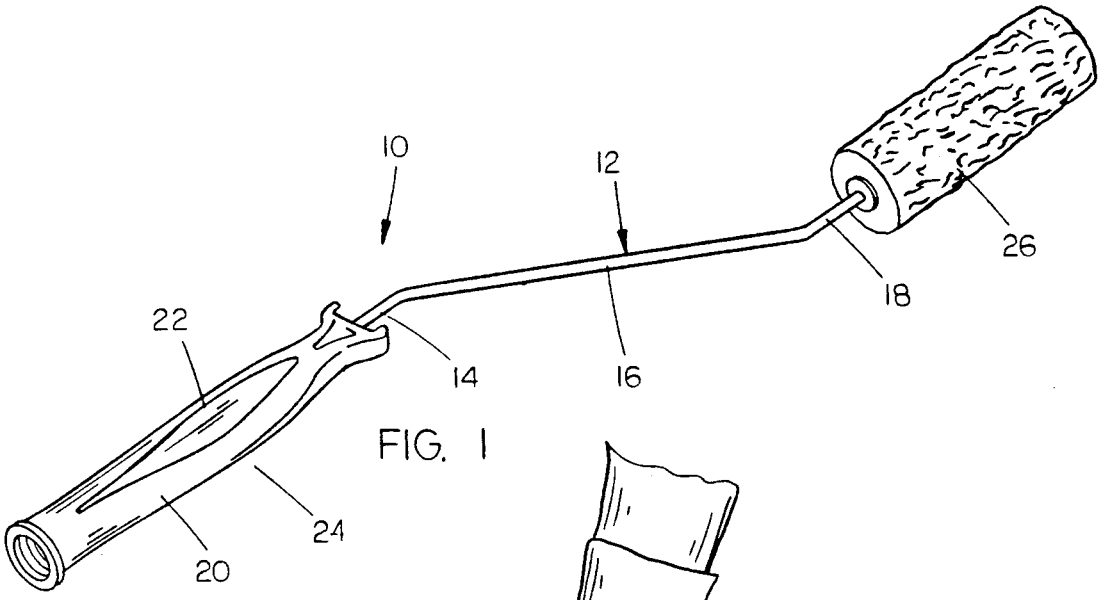
FIG. 1 is a perspective view of the paint roller of this invention.

A paint roller is described for painting such surfaces as railings, spindles, cylinders, etc. The paint roller of this invention comprises an elongated rod having a first end portion, an intermediate portion and a second end portion. The intermediate portion is disposed at an angle with respect to the first and second end portions with the longitudinal axes of the first and second end portions being disposed parallel to one another. The dimensions of the paint roller are such that the device may be easily used.

DESCRIPTION OF THE PREFERRED EMBODIMENT

The paint roller of this invention is referred to generally by the reference numeral 10. Paint roller 10 includes an elongated rod 12 including a first end portion 14, intermediate portion 16 and second end portion 18. It is preferred that the length of end portion 18 be approximately four and one-quarter inches while the preferred length of intermediate portion 16 is approximately four and one-quarter inches. The longitudinal axis of intermediate portion 16 is offset with respect to the longitudinal axis of end portion 14 at approximately 15 degrees. The longitudinal axis of end portion 18 is offset from the longitudinal axis of intermediate portion 16 approximately 15 degrees so that the longitudinal axes of end portions 14 and 18 are disposed parallel to one another. Further, the dimensions of the end portions and the intermediate portion is such that the longitudinal axis of end portion 18 is offset with respect to the longitudinal axis of end portion 14 approximately one and one-quarter inches.

Handle 20 is mounted on end portion 14 and includes opposing flat surfaces 22 and 24 to aid in gripping the paint roller. Paint applicator roller 26 is rotatably mounted on end portion 18 and preferably has a diameter of approximately one and one-half inch and a length of approximately three and one-quarter inches. Applicator roller 26 is removably mounted on end portion 16 to permit the replacement thereof.

Figure 2:
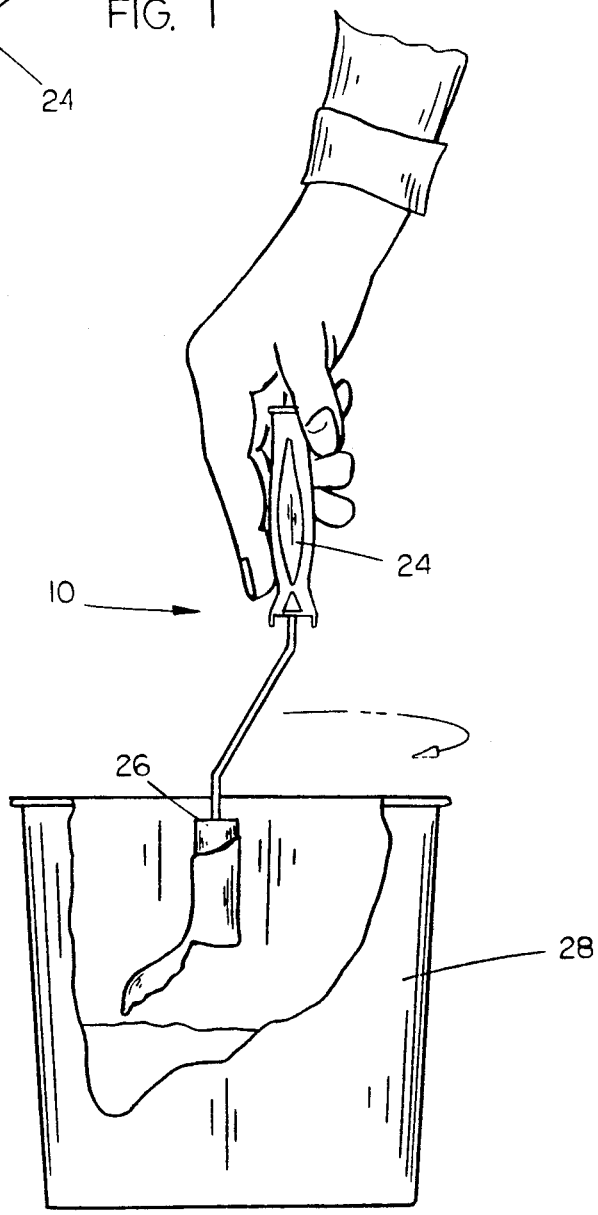
FIG. 2 is a side view illustrating a person rolling the applicator roller around the inside of a pail to remove excess paint from the applicator roller.

In use, the painter grips handle 20 and dips the paint applicator roller 26 downwardly into a paint bucket or the like referred to generally by the reference numeral 28. Excess paint may be removed from the roller 26 by simply rolling the roller 26 around the interior surface of the paint bucket 28 (FIG. 2) which eliminates the need for a separate paint tray as in the prior art paint roller devices.

Paint may be applied to the irregular surfaces in the customer fashion with the dimensions of the roller and the angular relationship of the end portions permitting the convenient application of paint to surfaces such as railings, spindles, cylinders, etc. The fact that end portion 18 is offset approximately one and one-quarter inches from end portion 14 permits the paint to be easily applied with a relatively light grip on the handle 20 being required which aids in eliminating carpal tunnel injury to the painter.

Figure 3:
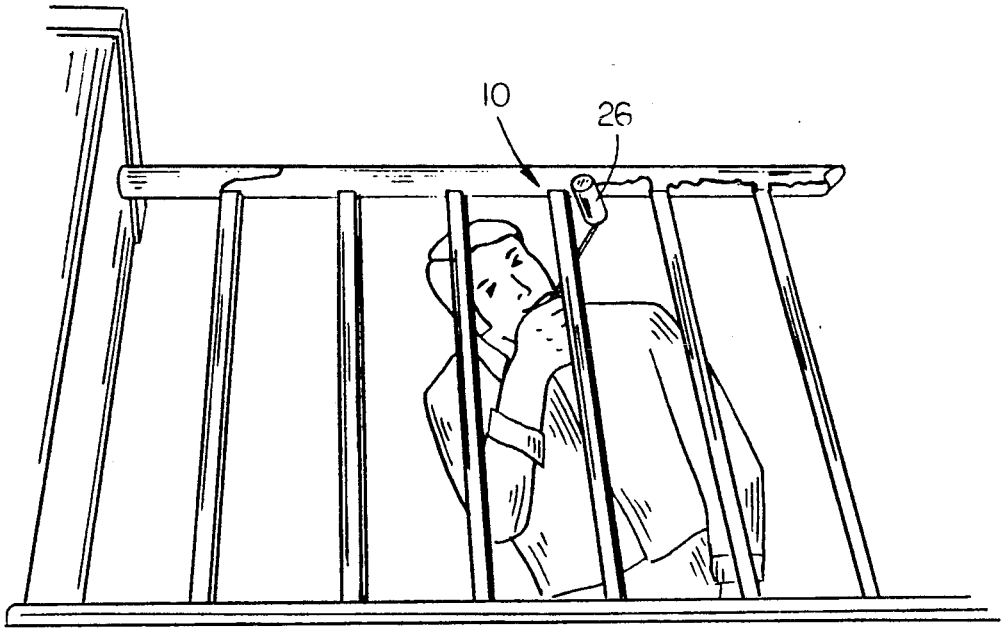
FIG. 3 is a view illustrating a painter using the device of this invention.
Figure 4:
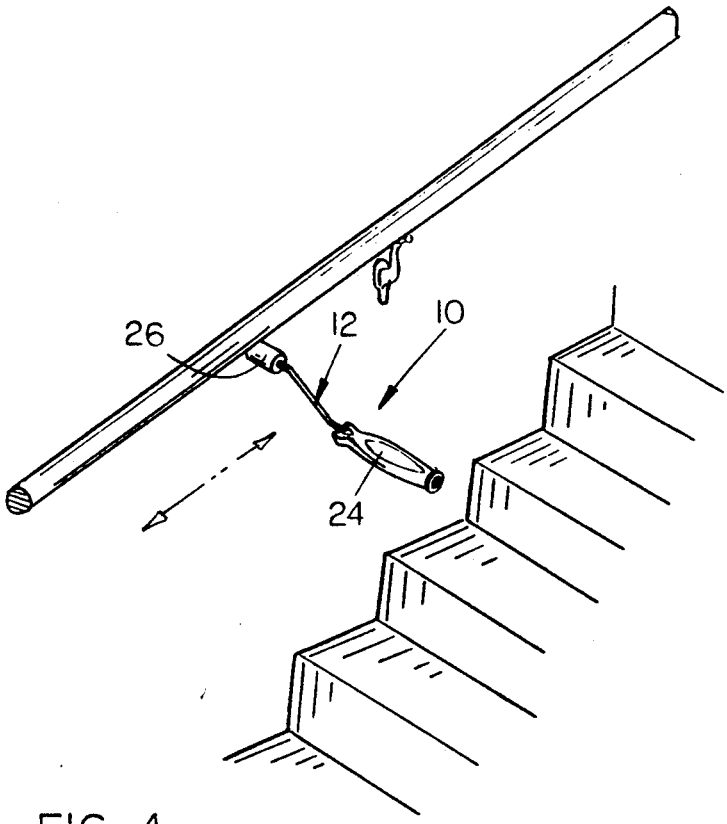
FIG. 4 is a perspective view illustrating the manner in which the roller of this invention is used to paint a hand railing.

FIG. 3 illustrates the paint roller of this invention being used to paint a cylindrical rail while FIG. 4 illustrates the device being used to paint an inclined hand rail.

It can therefore be seen that the invention accomplishes at least all of its stated objectives.

I claim:

1. A paint roller comprising, a single elongated rod having an elongated first end portion, an elongated intermediate portion extending from said first end potion and having its longitudinal axis disposed at an approximate 15 degree angle with respect to the longitudinal axis of said first end portion, an elongated second end portion extending from said intermediate portion at an approximate 15 degree angle with respect thereto, the longitudinal axes of said first and second end portions being substantially parallel, said intermediate portion having a length of approximately four and one-quarter inches such that said first and second end portions are offset from one another approximately one and one-quarter inches, a handle mounted on said first end portion, and said handle having a length of approximately five and one-half inches and said second end portion having a length of approximately four and one-quarter inches, said handle having opposing flat parallel surfaces to aid in gripping the handle;

said surfaces oriented parallel to the plane in which said rod is located, such that the handle is gripped to orient the roller in a particular direction relative to the hand, a cylinder paint applicator having a length less than said second end portion rotatably and coaxially mounted on said second end portion, said applicator having a diameter of about one and one-half inches, and a length of about three and one-quarter inches.

* * * * *